United States Patent [19]
Kawamoto et al.
[11] Patent Number: 4,919,294
[45] Date of Patent: Apr. 24, 1990

[54] BOTTOM STRUCTURE OF A THIN-WALLED CAN

[75] Inventors: Yoji Kawamoto; Tetsuo Yuhara, both of Nagasaki; Koichi Takagi, Nagoya; Kanji Udagawa, Sunto, all of Japan

[73] Assignees: Mitsubishi Jukogyo Kabushiki Kaisha; Mitsubishi Metal Corporation, both of Tokyo, Japan

[21] Appl. No.: 334,853

[22] Filed: Apr. 6, 1989

[30] Foreign Application Priority Data

Apr. 6, 1988 [JP] Japan ..... 63-83135
Mar. 9, 1989 [JP] Japan ..... 64-54874

[51] Int. Cl.[5] ..... B65D 7/42
[52] U.S. Cl. ..... 220/70; 220/66
[58] Field of Search ..... 220/66, 70; 206/508

[56] References Cited

U.S. PATENT DOCUMENTS 3,693,828 9/1972 Kneusel et al. ..... 220/70 X
3,730,383 5/1973 Dunn et al. ..... 220/70 X
3,904,069 9/1975 Toukmanian ..... 220/70 X
4,294,373 10/1981 Miller et al. ..... 220/70
4,646,930 3/1987 Karas et al. ..... 206/508 X
4,685,582 8/1987 Pulciani et al. ..... 220/70 X
4,768,672 9/1988 Pulciani et al. ..... 220/66
4,834,256 5/1989 McMillin ..... 220/66

*Primary Examiner*—Steven M. Pollard
*Attorney, Agent, or Firm*—Wenderoth, Lind & Ponack

[57] ABSTRACT

A thin-walled can for sealingly enclosing liquid or gas, including a dome section, a counter section, a ground section, a heel section, and a side wall section, is improved so as to enhance pressure-proofness for a given wall thickness or to reduce wall thickness for a given pressure-proofness. A cross sectional shape of the dome section is formed of a curve whose radius of curvature changes substantially continuously along the curve, and the counter section contiguous to the dome section is formed so as to align with the direction of extension of the dome section. Preferably, the angle formed between the cross-section of the counter section and a vertical line is chosen to be within the range of 0° to 15°. Furthermore, preferably the cross-sectional shape of the heel section extending from the counter section through the ground section to the side wall section is a circular arc that is inwardly convex.

3 Claims, 4 Drawing Sheets

BOTTOM STRUCTURE OF A THIN-WALLED CAN

BACKGROUND OF THE INVENTION

1. Field of the Invention

The present invention relates to a bottom structure of a thin-walled can for sealingly enclosing liquid or gas.

2. Description of the Prior Art

A bottom structure of a representative can in the prior art is illustrated in cross-section in FIG. 7. Such can bottom structure generally consists of a dome section 1, a counter section 2, a ground section 3, a heel section 4, and a side wall section 5. By the way, cans sold currently in the market are generally classified into the following three types of shapes:

| Type | Shape of Dome Section | Shape of Can Bottom Portion (Counter Section, Ground Section & Heel Section) |
|---|---|---|
| 1 | Spherical | V-shape |
| 2 | Flat | V-shape |
| 3 | Spherical | C-shape |

Cross-sectional shapes of representative bottom structures of the above three types are respectively illustrated in FIG. 7 (Type-1), FIG. 8 (Type-2) and FIG. 9 (Type-3). It is to be noted that the can of type-3 having a spherical dome section and a C-shaped bottom portion is of old-fashioned type and at present cans tend to be of type-1 or type-2.

The cross-sectional shapes of the bottom plates of cans in the prior art have an abrupt transition point of curvature. More particularly, an abrupt transition point of curvature in FIG. 7 is point A, where a radius of curvature $R_D$ of a spherical surface of the dome section changes abruptly to a radius of curvature $r_1$ of a corner with the counter section. Abrupt transition points of curvature in FIG. 8 are also present at point B in addition to a location corresponding to point A in FIG. 7, the point B being a point on an intersection line between a flat plane and a conical surface, where the cross-sectional curve bends sharply. With regard to the cross-sectional shape of the bottom plate of the old-fashioned type of can shown in FIG. 9, also an abrupt transition point of a curvature is present, though not specifically indicated. Therefore, the bottom structure of the can in the prior art involved the problem that if an inner pressure should act upon the inner surface of the can, local concentration of stress would arise at the abrupt transition point of curvature, resulting in plasticization of the can wall at that portion. Hence, the support for the dome section (bottom plate) would be deteriorated, and pressure-proofness of the can would be lowered.

In addition, for the purpose of smoothly transmitting a pressure acting upon the dome section 1 to the ground section 3, it is effective to select a counter-sink angle $\theta$ (the angle formed between the cross-section of the counter section 2 and an axial or vertical line) to be small. However, whether with a spherical dome or a flat dome, in order to select the counter-sink angle $\theta$ small a corner having a small radius of curvature must be provided. However, this would form the above-described abrupt transient point of a curvature. Thus, there is the problem that even if it is attempted to improve pressure-proofness of a can by reducing the counter-sink angle $\theta$, such attempt will not be effective.

SUMMARY OF THE INVENTION

It is therefore one object of the present invention to provide a novel bottom structure of a thin-walled can in which the aforementioned problems in the prior art have been resolved.

A more specific object of the present invention is to provide a bottom structure of a thin walled can having an improved pressure-proofness for a given wall thickness and having a reduced wall-thickness for a given pressure-proofness.

According to one feature of the present invention, there is provided a bottom structure of a thin-walled can, in which a cross-sectional shape of a dome section is formed of a curve whose radius of curvature changes substantially continuously, and a counter section contiguous to the dome section is formed so as to align with the direction of extension of the dome section.

According to another feature of the present invention, there is provided the above-featured bottom structure of a thin-walled can, in which counter-sink angle formed between the cross-section of the counter section and the vertical line is 0° to 15°.

According to still another feature of the present invention, there is provided the above-featured bottom structure of a thin-walled can, in which a cross-section shape of a heel section extending from the counter section through a ground section to a side wall section is a circular arc that is inwardly convex.

In the bottom structure of a thin-walled can according to the present invention, owing to the fact that the cross-sectional shape of a dome section is formed of a curve whose radius of curvature changes substantially continuously and a counter section contiguous to the dome section is formed so as to align with the direction of extension of the dome section, an abrupt transition point of curvature is not present, and accordingly, local concentration of stress will not arise. In addition, since the counter-sink angle is as small as 0° to 15°, pressure acting upon the dome section would be smoothly transmitted to the ground section. Furthermore, as the cross-sectional shape of a heel section is a circular arc that it inwardly convex, the bottom structure has the merits that it can withstand a large collapsing pressure and a displacement in the vertical direction of the can bottom portion upon buckling is small.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
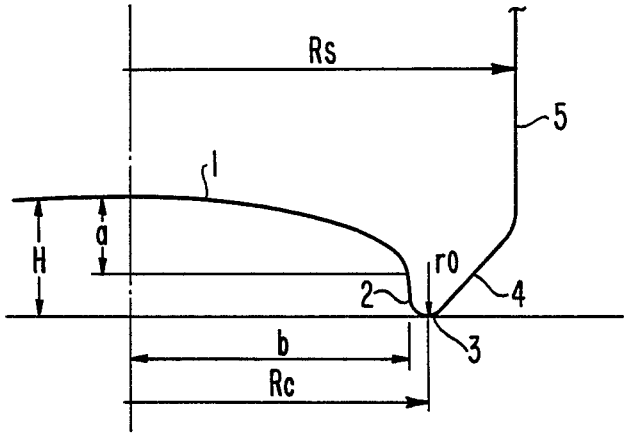
FIGS. 1 and 2 are cross-sectional views showing a part of a bottom structure of a thin-walled can according to first and second preferred embodiments, respectively, of the present invention.
Figure 3:
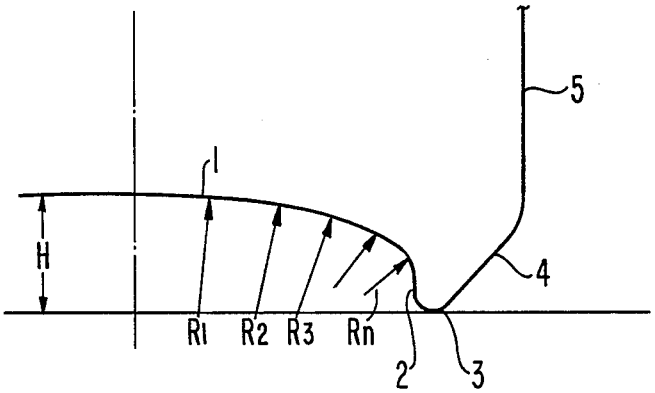
FIG. 3 is a diagrammatic view showing change of a radius of curvature in the case where a cross-sectional shape of a dome section is assumed to be an ellipse.

Now the present invention will be described in more detail in connection with the preferred embodiments illustrated in the drawings. FIG. 1 shows a cross-sectional shape of a bottom portion of a thin-walled can according to a first preferred embodiment of the present invention. In the embodiment shown in FIG. 1, the cross-section of a dome section 1 is formed of a part of an ellipse having a shortest radius of a mm and a longest radius of b mm. Accordingly, the curve representing the cross-sectional shape of the dome section 1 formed of a part of an ellipse is a curve whose radius of curvature ($R_1$, $R_2$, $R_3$, . . . , $R_n$) changes continuously as shown in FIG. 3. Hence, at the joining point between the dome section 1 and a counter section 2, there is not an abrupt transition point of curvature, but rather these respective sections are continuously joined via a smooth surface.

Figure 4:
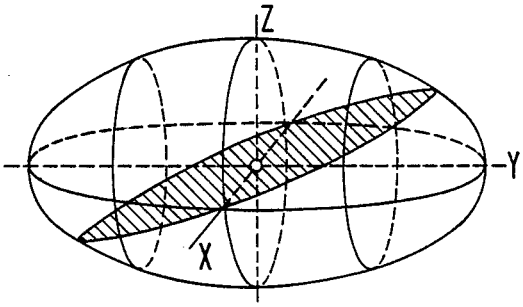
FIGS. 4, 5 and 6 are diagrammatic views showing examples of curves that can be utilized as a cross-sectional shape of a dome section.
Figure 5:
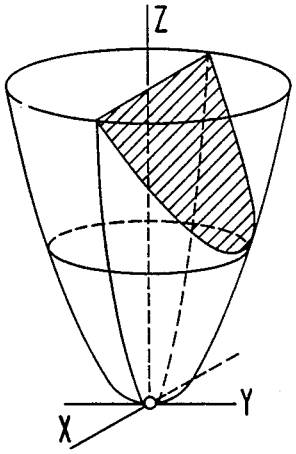
Figure 6:
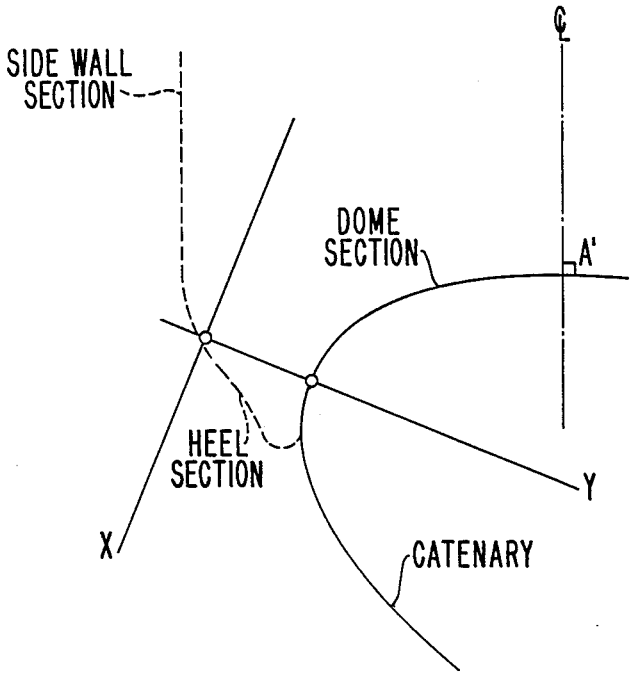

It is to be noted that the curve representing the cross-sectional shape of the dome section is not limited to only a part of an ellipse as shown in FIG. 1, but rather, as long as it is a curve whose radius of curvature changes substantially continuously, other curves can be employed. For instance, a part of a curve such as a parabola, a catenary, a cycloid, an involute of a circle, a hyperbolic spiral or the like are usable, and furthermore a curve of a cross-section of a solid figure as shown in FIG. 4 or 5 also can be employed. More particularly, in the case illustrated in FIG. 4 a curve formed by a contour of a cross-section passing through a center of an ellipse as hatched in the figure can be utilized, and in the case illustrated in FIG. 5 a curve formed by a contour of a cross-section intersecting with a center axis of a parabolic surface as hatched in the figure can be utilized. Besides, in the case where, by way of example, a catenary has been employed and applied to a cross-sectional shape of a dome section as shown in FIG. 6, a straight line (a dashdot line) perpendicular to the curve at an arbitrary point A′ can be employed as a center line (center axis) of a can and a part of the catenary can be utilized as the cross-sectional shape of a dome section. Also, in addition to the above-described respective curves, so long as a radius of curvature changes substantially continuously, any curve can be utilized.

Figure 7:
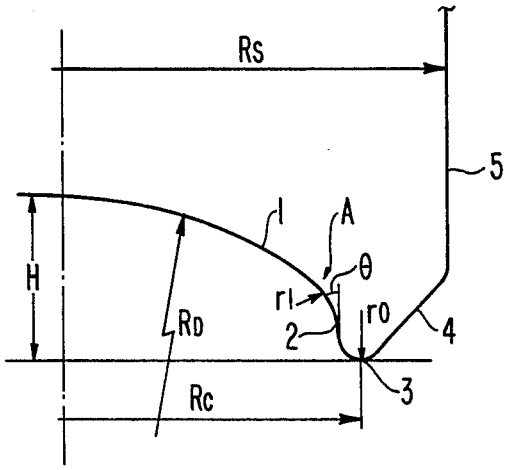
FIG. 7 (PRIOR ART)
FIGS. 7, 8 and 9 are cross-sectional views showing parts of a bottom structures of thin-walled cans in the prior art, the dome cross-sectional shapes of which are spherical, flat and spherical (C-type), respectively.
Figure 8:
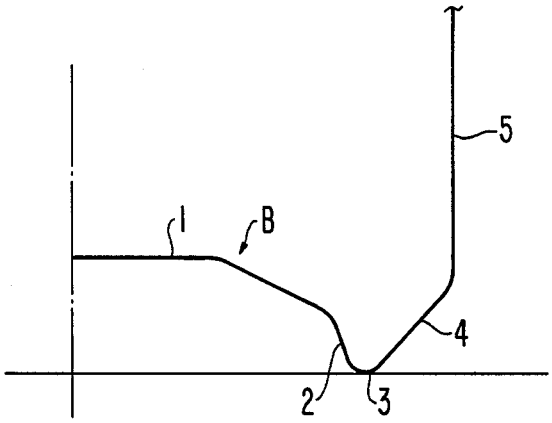
FIG. 8 (PRIOR ART)
Figure 9:
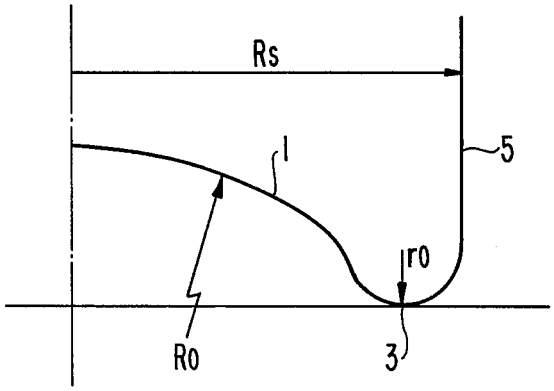
FIG. 9 (PRIOR ART)

In the case shown in FIG. 1, the angle formed between the cross-section of counter section 2 and to a vertical line (see FIG. 7), that is the counter-sink angle $\theta$, is 0°, and the counter section 2 continues to the ground section 3. According to the present invention, the counter-sink angle $\theta$ is selected in the range of 0° to 15°, and in this case, when the dome section 1 and the counter section 2 are joined, an abrupt transition point of curvature would not be produced at the joining point, but the joining portion can be formed in a continuous shape consisting of a smooth surface.

Figure 2:
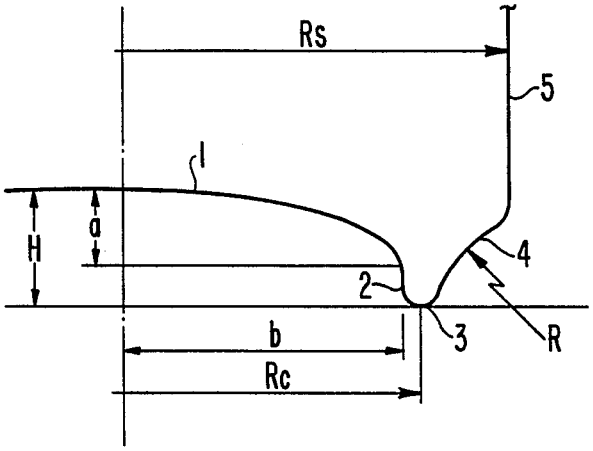

FIG. 2 shows a second preferred embodiment of the present invention, in which a dome section 1, a counter section 2, a ground section 3 and a side wall section 5 are identical to those of the embodiment shown in FIG. 1, but the structure of a heel section 4 is different from the heel section in FIG. 1. More particularly, in FIG. 2, the heel section 4 has a cross-sectional shape consisting of a circular arc having a radius R that is inwardly convex. It is to be noted that in the case where this radius R is chosen to be 2–10 mm the effect of the novel bottom structure is large. For instance, in the case where R=7.5 mm is chosen, a collapsing pressure is 8.42 kg/cm$^2$, which is excellent compared to collapsing pressures of 8.38 kg/cm$^2$ and 8.36 kg/cm$^2$ in the cases of R=12.5 mm and R=17 mm, respectively. In addition, a displacement in the vertical direction of the can bottom portion upon buckling is 0.520 mm when the radius of curvature is R=7.5 mm, which is small compared to the values of displacement of 0.529 mm and 0.561 mm in the cases of R=12.5 mm and R=17 mm, respectively. It is to be noted that in the case where the radius of curvature is chosen to be R=2 mm or less, the bend shaping of the heel section becomes difficult.

Since the present invention is constituted as described in detail above, the pressure-proofness of a bottom portion of a can can be improved, and the can can be thin-walled.

Here, one example of the effects of the present invention which has been experimentally confirmed, will be disclosed in the following. In connection with a bottom structure of a can in which a side wall radius ($R_s$) is 66.0 mm, a ground section radius ($R_c$) is 51.1 mm, a center depth (H) is 9.5 mm, a ground section punch tip end radius ($r_o$) is 1.5 mm and a counter-sink angle ($\theta$ in FIG. 7) is 0°, pressure-proofnesses in the cases where an elliptic cross-sectional dome whose cross-section shape is one of the curves formed so that the radius of curvature may be changed substantially continuously according to the present invention, and a spherical dome and a flat dome in the prior art were employed as the dome section, are comparatively shown in the below. It is to be noted that the test material was 3004 series aluminum alloy, whose 0.2% proof stress after anealing of 210° C.×10 Min. was 28 kg/mm$^2$, whose original sheet thickness was 0.365 mm, and the conditions other than the dome shape were the same.

| | Elliptic Cross-Section Dome (the Present Invention) | Spherical Dome | Flat Dome |
|---|---|---|---|
| Pressure-Proofness Pcr (kg/cm$^2$) | 9.95 | 8.74 | 8.36 |

It could be confirmed that pressure-proofness of a can employing the elliptic cross-section dome according to the present invention was improved by about 14% compared to a can having a spherical dome and by about 20% compared to a can having a flat dome. In addition, in the case where the radius R of the circular arc of the heel section was chosen to be R=2–10 mm, stability when a plurality of cans were stacked was extremely good in the case of R=7.5 mm a collapsing pressure was 8.42 kg/cm$^2$ which was better than that in the case of 10 mm or more, and displacement in the vertical direction of the can bottom portion upon buckling was 0.52 mm which was smaller than that in the other cases.

Accordingly, in the case where pressure-proofness is the same, as compared to cans having a spherical dome or a flat dome, the cans having a dome section with a cross-sectional shape whose radius of curvature changes substantially continuously according to the present invention can be of reduced sheet thickness of the can bottom portion.

While a principle of the present invention has been described above in connection to preferred embodiments of the invention, it is a matter of course that many apparently widely different embodiments can be made without departing from the spirit of the present invention.

What is claimed is:

1. A bottom structure of a thin-walled can, said structure comprising a dome section having a cross-sectional shape formed of a curve whose radius of curvature changes substantially continuously, and a counter section contiguous to said dome section and formed so as to align with the direction of extension of said dome section.

2. A bottom structure of a thin-walled can as claimed in claim 1, wherein the angle formed between the cross-section of said counter section and a vertical line is 0° to 15°.

3. A bottom structure of a thin walled can as claimed in claim 1, wherein a cross-section shape of a heel section extending from said counter section through a ground section to a side wall section is a circular arc that is inwardly convex.

* * * * *